US005144916A

United States Patent [19]

Yoshida et al.

[11] Patent Number: 5,144,916

[45] Date of Patent: Sep. 8, 1992

[54] VEHICULAR ENGINE COOLING APPARATUS

[75] Inventors: Masato Yoshida, Kyoto; Takanao Yokoyama, Kanagawa; Muneyoshi Nanba, Kyoto; Yoshihiko Kato, Novi; Kazumasa Iida; Katsuhiko Miyamoto, both of Kyoto, all of Japan

[73] Assignee: Mitsubishi Jidosho Kogyo Kabushiki Kaisha, Tokyo, Japan

[21] Appl. No.: 793,143

[22] Filed: Nov. 18, 1991

[51] Int. Cl.[5] ..... F01P 7/02

[52] U.S. Cl. ..... 123/41.12; 123/41.15

[58] Field of Search ..... 123/41.01, 41.12, 41.15, 123/41.49

[56] References Cited

U.S. PATENT DOCUMENTS 4,327,674 5/1982 Takei ..... 123/41.49

4,774,910 10/1988 Aihara et al. ..... 123/41.49

5,018,484 5/1991 Naitoh ..... 123/41.12

*Primary Examiner*—Noah P. Kamen

[57] ABSTRACT

Provided according to the present invention is a vehicular engine cooling apparatus comprising cooling fan means for cooling at least one of an engine and an environment of the engine, the engine being operated with use of any of two or more different fuels and a mixed fuel formed of a combination of the different fuels. This apparatus further comprises a mixture ratio sensor for detecting the mixture ratio of the two or more different fuels, and a controller for actuating the cooling fan means in accordance with the fuel mixture ratio detected by the mixture ratio sensor, after the engine is stopped. Preferably, the cooling fan is operated only during a predetermined operating time set in accordance with the fuel mixture ratio and the temperature of at least one of the engine and the environment of the engine.

11 Claims, 5 Drawing Sheets

VEHICULAR ENGINE COOLING APPARATUS

BACKGROUND OF THE INVENTION

1. Field of the Invention

The present invention relates to a vehicular engine cooling apparatus used in a vehicle, such as an automobile, and adapted to cool an engine and/or its environment after the engine is stopped.

2. Description of the Related Art

When an engine is stopped immediately after a vehicle, such as an automobile, goes up a steep slope or continuously runs at high speed on a superhighway, the temperature in an engine compartment rises due to a shortage of cooling air, and vapor lock occurs in a fuel injection valve, fuel supply passage, etc., possibly making the engine operation unstable at the restart of the engine. In order to prevent the vapor lock, the electrically-operated cooling fan may be operated to lower the temperature of the engine and its environment to a level where that the vapor lock is not liable to occur, after the engine is stopped.

If the cooling fan is operated without any restriction after the engine is stopped, however, a battery for use as its power source is wasted, and undue motor noises are produced. In a conventional engine cooling apparatus, therefore, the environmental temperatures of the engine, such as the fuel temperature, are monitored after the engine is stopped, and the engine and its environment are cooled by the cooling fan for a predetermined time when the monitored temperatures are higher than a preset temperature. In a gasoline engine car, the cooling apparatus of this type can produce a measure of effect against vapor lock.

In an automobile, e.g., an alcohol engine car, which uses a mixed fuel, however, if a mixture of gasoline and methanol is used for an alcohol fuel, for example, a so-called azeotropic effect is produced such that the saturated vapor pressure of the fuel becomes much higher than that in the case where pure gasoline or pure methanol is used for the fuel, provided that the methanol mixture ratio, that is, the mixture ratio of methanol to gasoline, is within a specific range. This azeotropic effect is not limited to the case of the mixture of gasoline and methanol, and may be generally observed when a mixture of two or more different fuels is used for the fuel. In a vehicle which uses two or more different fuels for its working fuels, therefore, vapor lock can very easily occur, so that the engine cannot be readily restarted.

SUMMARY OF THE INVENTION

The object of the present invention is to provide a vehicular engine cooling apparatus capable of restraining fuel vapor lock effectively and efficiently so that an engine can be normally restarted.

In order to achieve the above object, a vehicular engine cooling apparatus according to the present invention comprises cooling fan means for cooling at least one of an engine and an environment of the engine, the engine being operated with use of any of two or more different fuels and a mixed fuel formed of a combination of the different fuels. The apparatus further comprises a mixture ratio sensor for detecting the mixture ratio of the two or more different fuels, and control means for actuating the cooling fan means in accordance with the fuel mixture ratio detected by the mixture ratio sensor, after the engine is stopped.

According to the present invention, the cooling fan means for cooling the engine and/or its environment is actuated in accordance with the fuel mixture ratio detected by the mixture ratio sensor, after the engine is stopped. Accordingly, the engine and/or its environment are optimally cooled according to the liability to fuel vapor lock, which varies primarily depending on the fuel mixture ratio. Thus, vapor lock attributable to azeotropy, which is generally caused when two or more different fuels are mixed, can be restrained effectively and efficiently, so that the engine is normally restarted.

Preferably, the engine cooling apparatus of the present invention further comprises temperature sensing means for detecting the temperature of at least one of the engine and the environment of the engine, and the control means actuates the cooling fan means when the temperature detected by the temperature sensing means exceeds a preset temperature. Thus, the cooling fan means is operated not only on the basis of the fuel mixture ratio, but also in consideration of the liability of the engine and/or its environment to fuel vapor lock. Thus, vapor lock can be more effectively restrained, and the cooling fan is efficiently operated, so that a waste of a battery is reduced, and the motor noise level is lowered.

Preferably, moreover, the control means sets a predetermined operating time in accordance with the fuel mixture ratio detected by the mixture ratio sensor and the temperature detected by the temperature sensing means. In this case, the predetermined operating time for the cooling fan means can be optimally set according to the liability to fuel vapor lock, so that the aforementioned effects is enhanced.

Preferably, furthermore, the control means sets the predetermined operating time within the range of a preset time, the cooling fan means is formed of an electrically-operated cooling fan operated by a battery as a power source, and the preset time is set within the range of the maximum working time of the battery during which at least the cooling fan alone can be operated continuously. Thus, the cooling fan means is not operated for more than the maximum working time of the battery, and its excessive consumption is prevented.

The above and other objects, features, and advantages of the invention will be more apparent from the ensuing detailed description taken in connection with the accompanying drawings.

DETAILED DESCRIPTION OF THE PREFERRED EMBODIMENT

Figure 1:
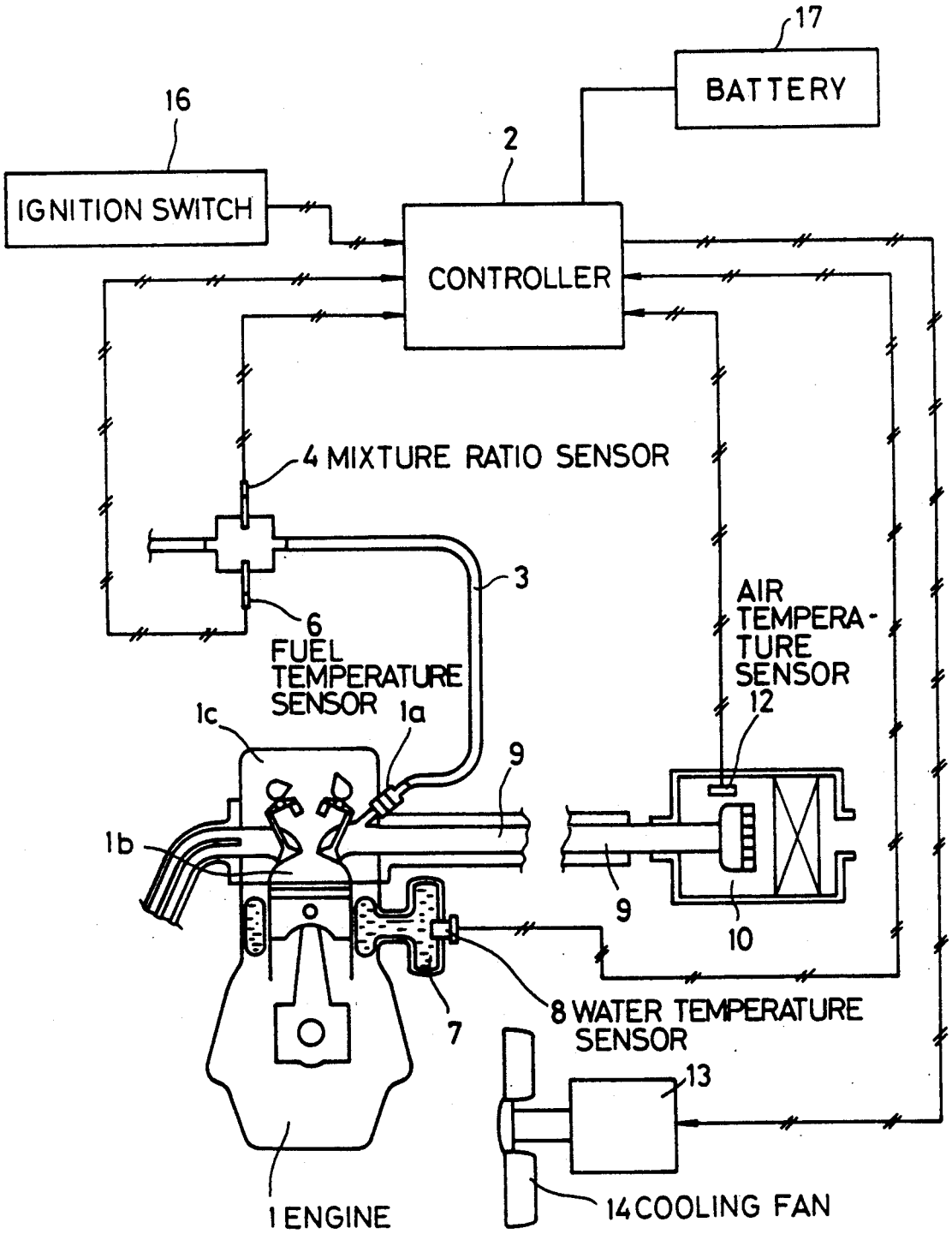
FIG. 1 is a block diagram showing an outline of a vehicular engine cooling apparatus.

FIG. 1 shows an arrangement of a vehicular engine cooling apparatus according to the present invention.

The engine cooling apparatus shown in FIG. 1 is arranged, for example, in an alcohol engine car which uses a mixture of methanol and gasoline for its fuel. An alcohol engine 1 is operated with use of any of pure methanol, pure gasoline, and a mixture of the two. The engine 1 and its operational devices are constructed in the same manner as those of a gasoline engine car except for the portions mentioned below, so that a description of those elements is omitted herein.

The engine 1 is provided with a fuel injection nozzle 1*a*, to which a fuel line 3 is connected. A mixture ratio sensor 4 and a fuel temperature sensor 6 are arranged in the fuel line 3, through which the pressurized fuel is supplied to the injection nozzle 1*a*. The sensor 4 is used to detect the methanol mixture ratio of the mixed fuel used, that is, the mixture ratio of methanol to gasoline. The temperature sensor 6, which constitutes temperature sensor means, is used to detect the fuel temperature. The respective outputs of the sensors 4 and 6 are connected electrically to the input of a controller 2, which constitutes control means.

A water temperature sensor 8 is arranged in a cooling water passage 7 in the engine 1. The sensor 8, which constitutes temperature sensor means, is used to detect the temperature of engine cooling water. The output of the sensor 8 is also connected electrically to the input of the controller 2.

A cylinder head 1*c* of the engine 1 is connected with an air passage 9 through which suction air is introduced into a combustion chamber 1*b* of the engine 1. An air cleaner 10 for cleaning the suction air is disposed at the inlet of the passage 9. The air cleaner 10 is provided with an air temperature sensor 12, which constitutes temperature sensor means for detecting the suction air temperature. The output of the sensor 12 is also connected electrically to the input of the controller 2.

Further, an ignition switch 16 is connected to the input of the controller 2, and its on-off position signal is supplied to the controller. The controller 2 is also connected with the output of a battery 17.

The output of the controller 2 is connected to a fan motor 13. The motor 13, which is operated by the battery 17 as a power source, serves to rotate a cooling fan 14. The motor 13 and the fan 14 constitute cooling fan means. The cooling fan 14 may, for example, be a radiator fan which cools the engine 1 and its environment, as well as the engine cooling water.

Figure 2:
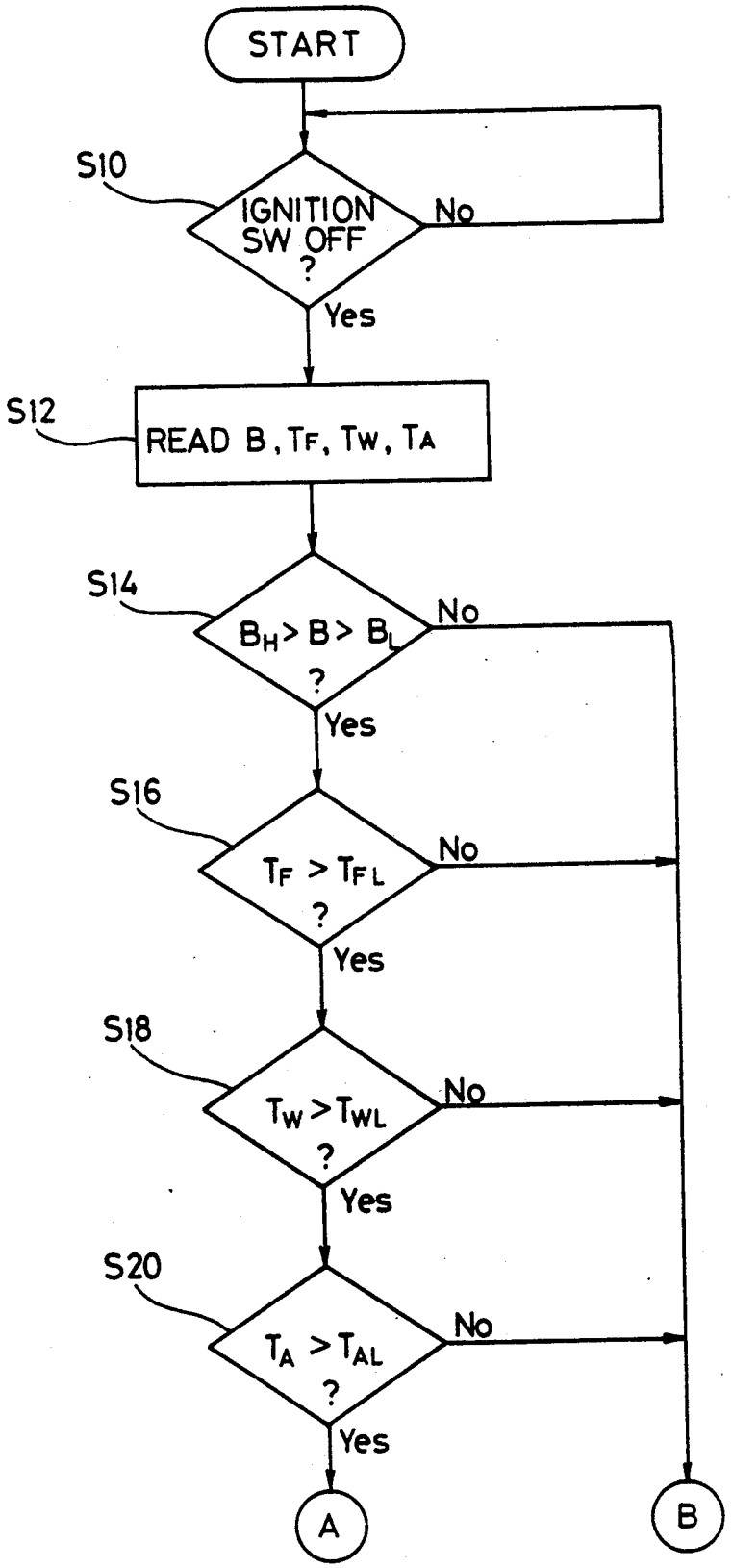
FIG. 2 is a flow chart showing the former half of a cooling fan control routine executed by a controller.
Figure 3:
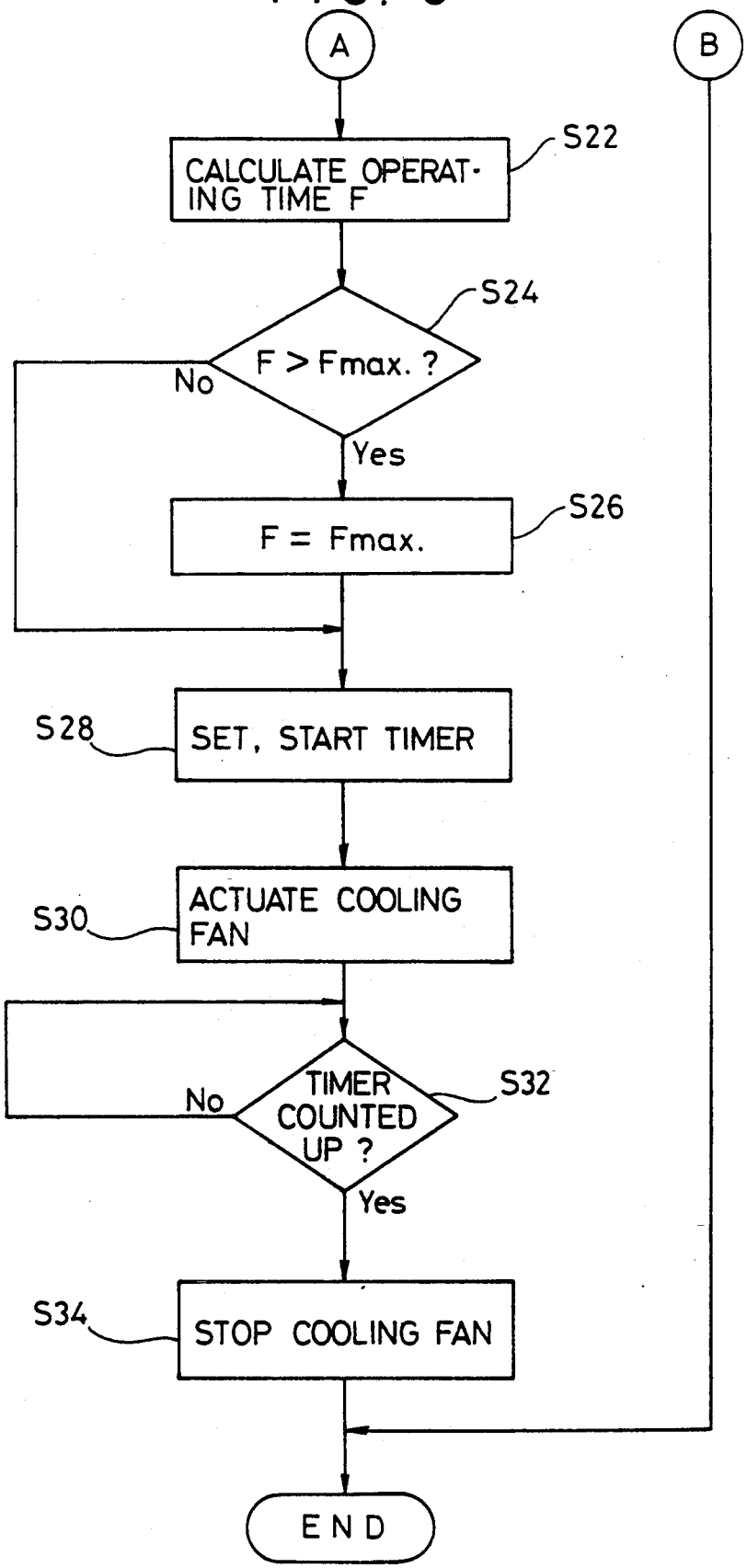
FIG. 3 is a flow chart showing the latter half of the cooling fan control routine executed by the controller.

Referring now to the flow charts of FIGS. 2 and 3, processes of cooling fan control executed by the controller 2 will be described.

The controller 2, which continually monitors the on-off position of the ignition switch 16, first determines whether or not the switch 16 is off (Step S10).

If the decision in Step S10 is NO, the process of Step S10 is repeated. If the decision in Step S10 is YES, the controller 2 then reads a methanol mixture ratio B detected by the mixture ratio sensor 4, a fuel temperature $T_F$ detected by the fuel temperature sensor 6, a cooling water temperature $T_W$ detected by the water temperature sensor 8, and a suction air temperature $T_A$ detected by the air temperature sensor 12 (Step S12).

Then, the controller 2 determines whether or not the detected methanol mixture ratio B is lower than a predetermined upper limit set value $B_H$ and is higher than a predetermined lower limit set value $B_L$ (Step S14). The set values $B_H$ and $B_L$ of the methanol mixture ratio B are values such that occurrence of vapor lock in the fuel line 3 or the like can be estimated with a desired probability when the ratio B is between the values $B_H$ and $B_L$ and if the following requirements (Steps S16 to S20) on temperature are met. If the decision in Step S14 is NO, that is, if the methanol mixture ratio B is equal to the upper limit set value $B_H$ or higher, or equal to the lower limit set value $B_L$ or lower, the routine concerned is finished, and the cooling of the engine 1 and the like (mentioned in detail later) is not executed.

If the decision in Step S14 is YES, it is then determined whether or not preset values $T_{FL}$, $T_{WL}$ and $T_{AL}$ are exceeded, respectively, by the fuel temperature $T_F$, cooling water temperature $T_W$, and suction air temperature $T_A$ read in Step S12, in the order named (Steps S14 to 20), because the production of saturated vapor pressure of the fuel greatly depends on these temperatures. If any of the decisions in Steps S14 to S20 is NO, the routine concerned is finished, and the cooling of the engine 1 and the like is not executed.

If all of the decisions in Steps S14 to S20 are YES, the cooling of the engine 1 and the like is then executed in the following manner.

First, a cooling fan operating time F is calculated according to equation (1) (Step S22), on the basis of the methanol mixture ratio B, fuel temperature $T_F$, cooling water temperature $T_W$, and suction air temperature $T_A$ detected in Step S12.

$$F=f_1(B, T_F)+f_2(T_A)+f_3(T_W). \quad (1)$$

Figure 4:
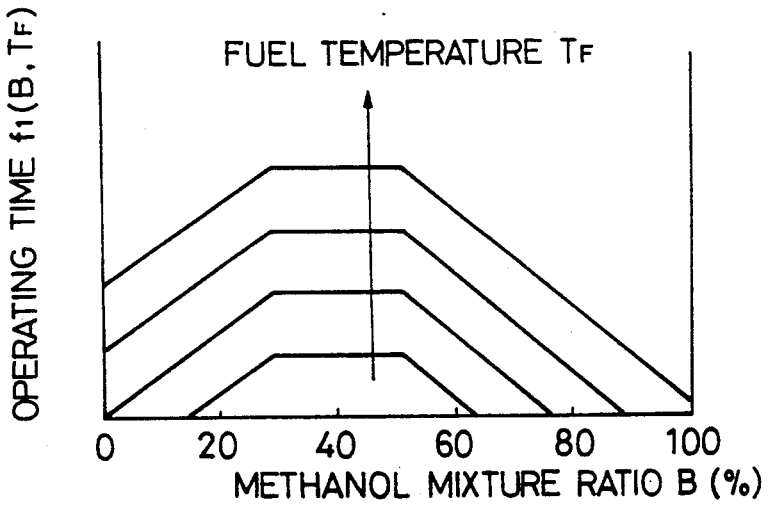
FIG. 4 is a graph showing the relationships between a methanol mixture ratio B, a fuel temperature $T_F$, and a first cooling fan operating time $f_1(B, T_F)$.

Referring to FIG. 4, more specifically, a first cooling fan operating time $f_1(B, T_F)$ is obtained in accordance with the methanol mixture ratio B and the fuel temperature $T_F$. FIG. 4 shows the relationship between the methanol mixture ratio B and the first cooling fan operating time $f_1(B, T_F)$ obtained with use of the fuel temperature $T_F$ as a parameter. If the fuel temperature $T_F$ is constant, the operating time $f_1(B, T_F)$ is set so that its maximum can be obtained when the methanol mixture ratio B ranges from about 30% to about 50%. The reason is that the saturated vapor pressure of the fuel is substantially at its maximum and the possibility of occurrence of vapor lock is highest when the methanol mixture ratio B ranges from about 30% to about 50%. The predetermined upper and lower set values $B_H$ and $B_L$ of the methanol mixture ratio B are set so that the aforesaid range lies between them. If the methanol mixture ratio B is constant, on the other hand, the first cooling fan operating time $f_1(B, T_F)$ is set so that the higher the fuel temperature $T_F$, the longer it will be.

Figure 5:
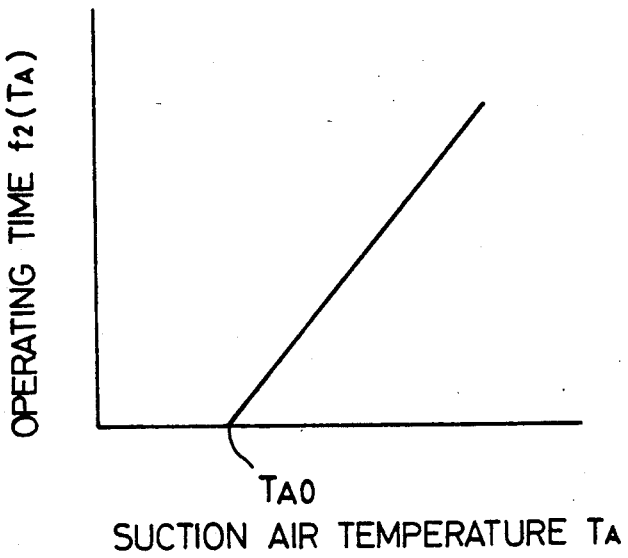
FIG. 5 is a graph showing the relationship between a suction air temperature $T_A$ and a second cooling fan operating time $f_2(T_A)$.

Referring now to FIG. 5, a second cooling fan operating time $f_2(T_A)$ is obtained on the basis of the suction air temperature $T_A$. FIG. 5 shows the relationship between the suction air temperature $T_A$ and the second cooling fan operating time $f_2(T_A)$. The value $f_2(T_A)$ is set so that it is zero when $T_A$ is not greater than a preset value $T_{AO}$, and that it increases as a linear function of $T_A$ after $T_{AO}$ is exceeded by $T_A$.

Figure 6:
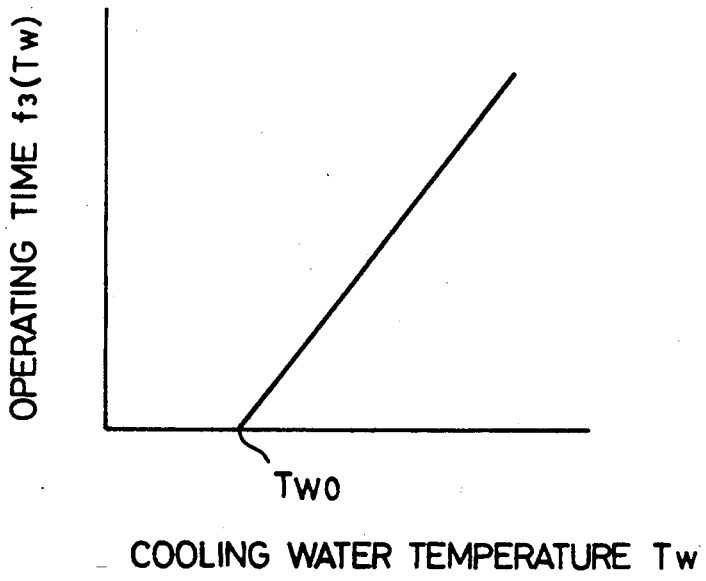
FIG. 6 is a graph showing the relationship between a cooling water temperature $T_W$ and a third cooling fan operating time $f_3(T_W)$.

Referring last to FIG. 6, a third cooling fan operating time $f_3(T_W)$ is obtained on the basis of the cooling water temperature $T_W$. FIG. 6 shows the relationship between the cooling water temperature $T_W$ and the third cooling fan operating time $f_3(T_W)$. The value $f_3(T_W)$ is set so that it is zero when $T_W$ is not greater than a preset value $T_{WO}$, and that it increases as a linear function of $T_W$ after $T_{WO}$ is exceeded by $T_W$.

The cooling fan operating time F is finally calculated by substituting the cooling fan operating times $f_1(B, T_F)$, $f_2(T_A)$, and $f_3(T_W)$, set in this manner, for the right member of equation (1).

Then, it is determined whether or not the cooling fan operating time F calculated in Step S22 exceeds a maximum cooling fan operating time Fmax. (Step S24). This maximum time Fmax. is a time within a range such that the battery 17 for the power supply to the fan motor 13 is not consumed excessively when the motor 13 is continuously operated during the time. If the decision in Step S16 is NO, a timer is set for the cooling fan operating time F calculated in Step S22, and is then started (Step S28). If the decision in Step S16 is YES, the cooling fan operating time F is replaced with the maximum cooling fan operating time Fmax. in Step S18, and the process of Step S22 is executed in the same manner as aforesaid. The aforesaid timer is an up-counter which counts the cooling fan operating time F set in Step S14 or S18 so that the operation of the fan motor 13 is stopped when the time F is counted up.

Subsequently, the controller 2 supplies electric power from the battery 17 to the fan motor 13, thereby actuating the cooling fan 14 (Step S30). Thereupon, the engine 1 and its environment, e.g., the fuel pump, fuel injection nozzle 1*a*, fuel line 3, etc., are cooled.

Then, it is determined whether or not the cooling fan operating time F is counted up by the timer (Step S32). If the decision in Step S32 is NO, the process of Step S32 is repeated until the timer counts up the time F. In other words, the cooling fan 14 continues to cool the engine 1 and its environment. If the decision in Step S26 is YES, the power supply from the battery 17 to the fan motor 13 is stopped, whereupon the cooling of the engine 1 and the like with the cooling fan 14 ends (Step S34). Thus, the present routine is finished.

The fuel used in the engine 1 is not limited to the mixture of methanol and gasoline, and may be pure methanol or pure gasoline. When using pure gasoline, whose methanol mixture ratio B is 0%, however, the predetermined lower limit set value $B_L$ may be set at zero, in order to operate the cooling fan 14 in this case.

As described above, the engine 1 and the like are cooled for the cooling fan operating time F calculated in accordance with the various variables, including the methanol mixture ratio B, fuel temperature $T_F$, cooling water temperature $T_W$, and suction air temperature $T_A$, which are positively associated with the occurrence of vapor lock. Thus, vapor lock attributable to azeotropy, which is caused when a mixed fuel is used in an alcohol engine car, is prevented effectively and efficiently. In this engine cooling apparatus, moreover, the operating time F for the cooling fan 14 is set within a range such that the battery 17 is not consumed excessively when the fan motor 13 is continuously operated, that is, is set at a value not greater than that of the maximum cooling fan operating time Fmax., as mentioned before. Accordingly, the battery 17 is prevented from being consumed by the power supply to the motor 13 and failing to enable a car drive thereafter.

The respective mounting positions of the mixture ratio sensor 4, fuel temperature sensor 6, water temperature sensor 8, and suction air temperature sensor 12 are not limited to the positions described above, and may be suitably shifted to better positions for a forecast of the occurrence of vapor lock.

The variables used together with the methanol mixture ratio B to forecast the occurrence of vapor lock are not limited to the fuel temperature $T_F$, cooling water temperature $T_W$, and suction air temperature $T_A$ obtained when the ignition switch 16 is off, and may be any one or two of these temperatures $T_F$, $T_W$, and $T_A$. Alternatively, the temperature of the engine 1 or those of its environment, e.g., engine body temperature, engine compartment temperature, lubricating oil temperature, etc., may be used for the variables. Alternatively may be used, moreover, any desired variables, e.g., the fuel temperature $T_F$, the cooling water temperature $T_W$, the suction air temperature $T_A$, and an engine speed Ne, or the duration periods of these factors, obtained when the ignition switch 16 is on, that is, when the vehicle is running or during the time interval which elapses from the instant that the vehicle stops until the ignition switch 16 is turned off.

The cooling fan 14 is not limited to the radiator fan, and may be a cooling fan for exclusive use or for common use with any other device. Also, the portions to be cooled may be variously changed. For example, the fuel injection nozzle 1*a*, fuel line 3, etc. may be dedicatedly cooled.

Furthermore, fuels applicable to for the vehicular engine cooling apparatus of the present invention is not limited to the mixed fuel formed of methanol and gasoline described in connection with the above embodiment, and may be any other mixed fuels or various other fuels constituting those mixed fuels.

What is claimed is:

1. A vehicular engine cooling apparatus, comprising:
cooling fan means for cooling at least one of an engine and an environment of the engine, the engine being operated with use of any of two or more different fuels and a mixed fuel formed of a combination of the different fuels; and
a mixture ratio sensor for detecting the mixture ratio of the two or more different fuels, and
control means for actuating said cooling fan means in accordance with the fuel mixture ratio detected by said mixture ratio sensor, after the engine is stopped.

2. An engine cooling apparatus according to claim 1, wherein said control means actuates the cooling fan means when the fuel mixture ratio detected by the mixture ratio sensor is within a preset range.

3. An engine cooling apparatus according to claim 1, further comprising temperature sensing means for detecting a temperature of at least one of the engine and the environment of the engine, and said control means actuates the cooling fan means when the temperature detected by the temperature sensing means exceeds a preset temperature.

4. An engine cooling apparatus according to claim 1, wherein said control means actuates the cooling fan means for a predetermined operating time.

5. An engine cooling apparatus according to claim 4, further comprising temperature sensing means for detecting a temperature of at least one of the engine and the environment of the engine, and said control means sets the predetermined operating time in accordance with the fuel mixture ratio detected by the mixture ratio sensor and the temperature detected by the temperature sensing means.

6. An engine cooling apparatus according to claim 3 or 5, wherein said temperature sensing means is formed of a fuel temperature sensor for detecting the fuel temperature of the engine.

7. An engine cooling apparatus according to claim 3 or 5, wherein said temperature sensing means is formed of an air temperature sensor for detecting the suction air temperature of the engine.

8. An engine cooling apparatus according to claim 3 or 5, wherein said temperature sensing means is formed of a water temperature sensor for detecting the cooling water temperature of the engine.

9. An engine cooling apparatus according to claim 5, wherein said temperature sensing means is formed of a fuel temperature sensor for detecting the fuel temperature of the engine, an air temperature sensor for detecting the suction air temperature of the engine, and a water temperature sensor for detecting the cooling water temperature of the engine, and said control means calculates the predetermined operating time F according to an operational expression $F=f_1(B, T_F)+f_2(T_A)+f_3(T_W)$, using a first operating time $f_1(B, T_F)$ calculated in accordance with the fuel mixture ratio B detected by the mixture ratio sensor and the fuel temperature $T_F$ detected by the fuel temperature sensor, a second operating time $f_2(T_A)$ calculated in accordance with the suction air temperature $T_A$ detected by the air temperature sensor, and a third operating time $f_3(T_W)$ calculated in accordance with the cooling water temperature $T_W$ detected by the cooling water temperature sensor.

10. An engine cooling apparatus according to claim 5, wherein said control means sets the predetermined operating time within the range of a preset time.

11. An engine cooling apparatus according to claim 10, wherein said cooling fan means is formed of an electrically-operated cooling fan operated by a battery as a power source, and said preset time is set within the range of the maximum working time of the battery during which at least the cooling fan can be continuously operated.

* * * * *

UNITED STATES PATENT AND TRADEMARK OFFICE

CERTIFICATE OF CORRECTION

PATENT NO. : 5,144,916

DATED : September 8, 1992

INVENTOR(S) : Masato Yoshida, et al

It is certified that error appears in the above-indentified patent and that said Letters Patent is hereby corrected as shown below:

On the title page, Item [30]: Foreign Priority Document: Please add
Japan 2-313058 11/19/90
Japan 2-314923 11/20/90

Signed and Sealed this

First Day of March, 1994

Bruce Lehman

BRUCE LEHMAN

*Commissioner of Patents and Trademarks*

*Attest:*

*Attesting Officer*